US007393171B2

(12) United States Patent
Fu

(10) Patent No.: US 7,393,171 B2
(45) Date of Patent: Jul. 1, 2008

(54) DEVICE AND METHOD OF BINDING BOOKS

(76) Inventor: Chun Fu Fu, 4F, No. 5, Lane 537, Jhongyang Rd., Fongyuan City, Taichung County (TW)

( * ) Notice: Subject to any disclaimer, the term of this patent is extended or adjusted under 35 U.S.C. 154(b) by 336 days.

(21) Appl. No.: 11/367,869

(22) Filed: Mar. 2, 2006

(65) Prior Publication Data

US 2007/0204753 A1 Sep. 6, 2007

(51) Int. Cl.
*B42C 19/00* (2006.01)
*B42C 11/00* (2006.01)

(52) U.S. Cl. ..... 412/5; 412/8; 412/9; 412/33; 412/900; 412/902; 100/38; 100/92; 156/908; D18/34.1

(58) Field of Classification Search ..... 100/38, 100/92, 312, 318; 412/1, 3, 4, 5, 8, 9, 21, 412/22, 23, 33, 36, 37, 41, 900, 901, 902; 156/499, 908; D18/34.1; 281/21.1
See application file for complete search history.

(56) References Cited

U.S. PATENT DOCUMENTS 3,261,044 A * 7/1966 Hoff ..... 412/9
3,321,786 A * 5/1967 Bolick, Jr. ..... 412/13
3,460,173 A * 8/1969 Stuertz ..... 412/13
4,146,942 A * 4/1979 Westra et al. ..... 412/10
4,150,453 A * 4/1979 Vaughn ..... 412/5
5,160,234 A * 11/1992 Lazar ..... 412/20

* cited by examiner

*Primary Examiner*—Jimmy T Nguyen

(57) ABSTRACT

A binding device includes an L-shaped frame including two uprights, a crossbar-shaped platen interconnecting the upright, a central screw having a bottom end secured to the platen, and a rectangular table having two rear corners secured to bottoms of the uprights; a base including two arcuate openings each formed along an edge of an upper portion of the side, and two adjustment knobs secured to both sides of the table proximate a front end of the table; and a heater releasably secured to a rear end of the table and a vertical section of the frame and including a front heating area. The adjustment knobs are adapted to slide in a range defined by two ends of the opening. The platen is adapted to lift and lower by operating the screw and press one or more books to be bound on the table. A book binding method is also disclosed.

4 Claims, 11 Drawing Sheets

DEVICE AND METHOD OF BINDING BOOKS

BACKGROUND OF THE INVENTION

1. Field of Invention

The present invention relates to binding devices and more particularly to an improved binder and a book binding method by utilizing same.

2. Related Art

A conventional binder is shown in FIGS. 1 to 4. A rectangular hard cover 10, in its extended state, comprises a lengthwise central adhesive 12 formed on its central portion 11. A plurality of sheets of paper are placed on either half portion of an inner surface of the cover 10. Fold the other half portion onto the sheets of paper. Next, hold the cover 10 in an upright position prior to inserting a lower portion thereof into a U-shaped slot 21 of a binder 20 to rest on a heating element 22 on the bottom of the slot 21. Next, activate the heating element 22 to melt the adhesive 12. Next, wait for a predetermined period of cooling time. Finally, remove the bound book from the binder 20.

However, the prior art binder suffered from a couple of disadvantages. For example, the slot 21 has a limited width. Thus, multiple book binding is not possible. Further, a person may have to use one hand to hold a book to be bound having a thickness less than the width of the slot 21 in an upright position prior to activating the heating element 22 for binding (i.e., the width of the slot 21 is not adjustable for accommodating books of different thickness). Thus, the need for improvement still exists.

SUMMARY OF THE INVENTION

It is therefore an object of the present invention to provide a binding device comprising an L-shaped frame including two uprights, a crossbar-shaped platen interconnecting the upright, a central screw having a bottom end secured to the platen, and a rectangular table having two rear corners secured to bottoms of the uprights; a base including two arcuate openings each formed along an edge of an upper portion of the side, and two adjustment knobs secured to both sides of the table proximate a front end of the table; and a heater releasably secured to a rear end of the table and a vertical section of the frame and including a front heating area; wherein the adjustment knobs are adapted to slide in a range defined by two ends of the opening, and the platen is adapted to lift and lower by operating the screw and press one or more books to be bound on the table.

In one aspect of the present invention a container having two adjustable book ends is formed on a rear end of the table proximate the heating area.

In another aspect of the present invention a case having a plurality of compartments of different widths is formed on a rear end of the table proximate the heating area.

It is another object of the present invention to in a binding device including an L-shaped frame including two uprights, a crossbar-shaped platen interconnecting the upright, a central screw having a bottom end secured to the platen, and a rectangular table having two rear corners secured to bottoms of the uprights; a base including two arcuate openings each formed along an edge of an upper portion of the side, and two adjustment knobs secured to both sides of the table proximate a front end of the table; and a heater releasably secured to a rear end of the table and a vertical section of the frame and including a front heating area; provide a binding process comprising the steps of (1) unfastening the adjustment knobs to slide same together with the table from lower ends of the openings to upper ends of the openings; (2) fastening the adjustment knobs and the table; (3) unfastening the screw to lift the platen to a predetermined height; (4) placing a book to be bound with sheets of paper being initially positioned in its central portion having its inner surface coated with adhesive; (5) sequentially placing one or more books to be bound on the book in step (4) if such is desired; (6) lowering the platen to place same on the top book to be bound; (7) fastening the screw to press the platen on the top book to be bound with the central portion of each book to be bound being in contact with the heating area; (8) activating the heater to heat and melt the adhesive for adhering the sheets of paper to the inner surfaces of the central portions; (9) deactivating the heater for cooling the one or more books to be bound for a predetermined period of time; (10) unfastening the screw and lifting the platen; and (11) removing the bound one or more books from the binding device.

The above and other objects, features and advantages of the present invention will become apparent from the following detailed description taken with the accompanying drawings.

DETAILED DESCRIPTION OF THE INVENTION

Figure 1:
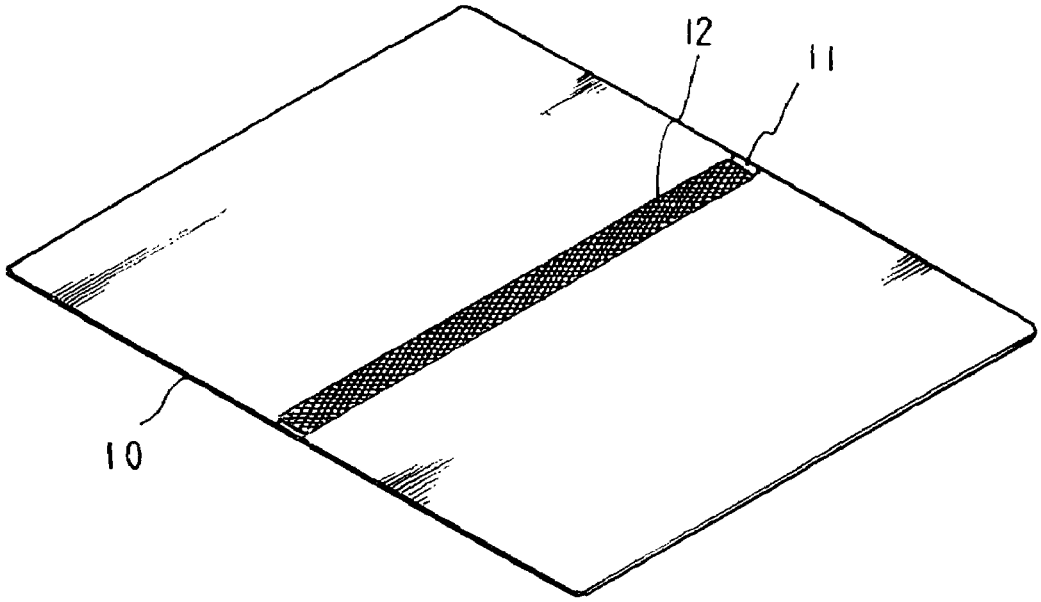
PRIOR ART FIG. 1
FIG. 1 is a perspective view of a book cover.
Figure 2:
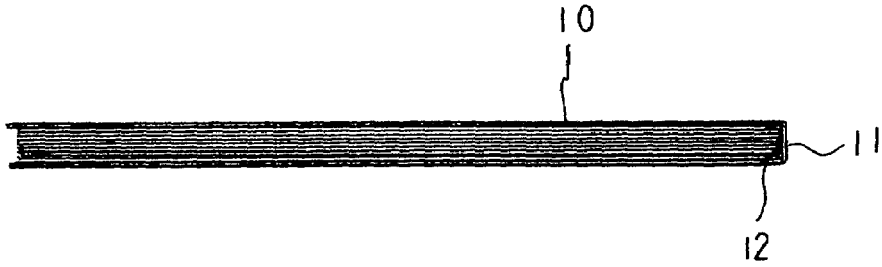
PRIOR ART FIG. 2
FIG. 2 is a side view of the folded cover in FIG. 1 with sheets of paper being initially positioned therein.
Figure 3:
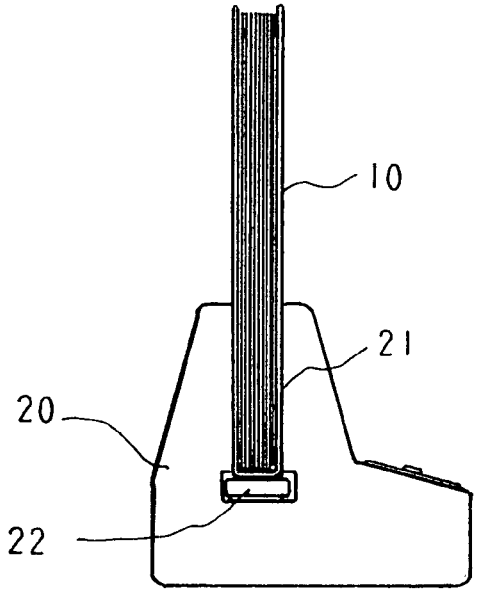
PRIOR ART FIG. 3
FIG. 3 is a side view schematically depicting the cover and sheets of paper in FIG. 2 being placed in a slot of binder prior to heating for binding as a book.
Figure 4:
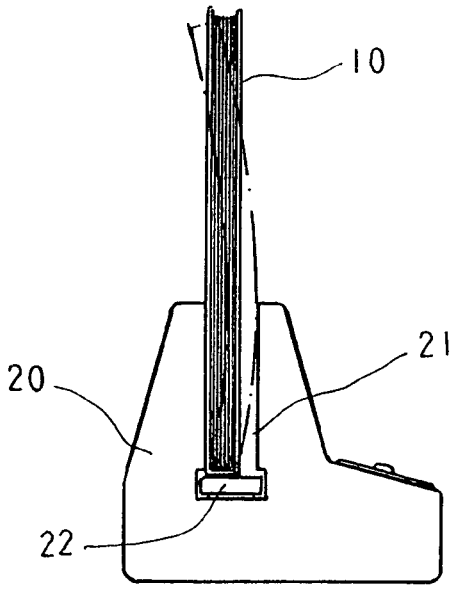
PRIOR ART FIG. 4
FIG. 4 is a view similar to FIG. 3, where a book having less number of sheets of paper is placed in the slot with dotted lines showing a possible bending of the sheets of paper prior to binding.
Figure 5:
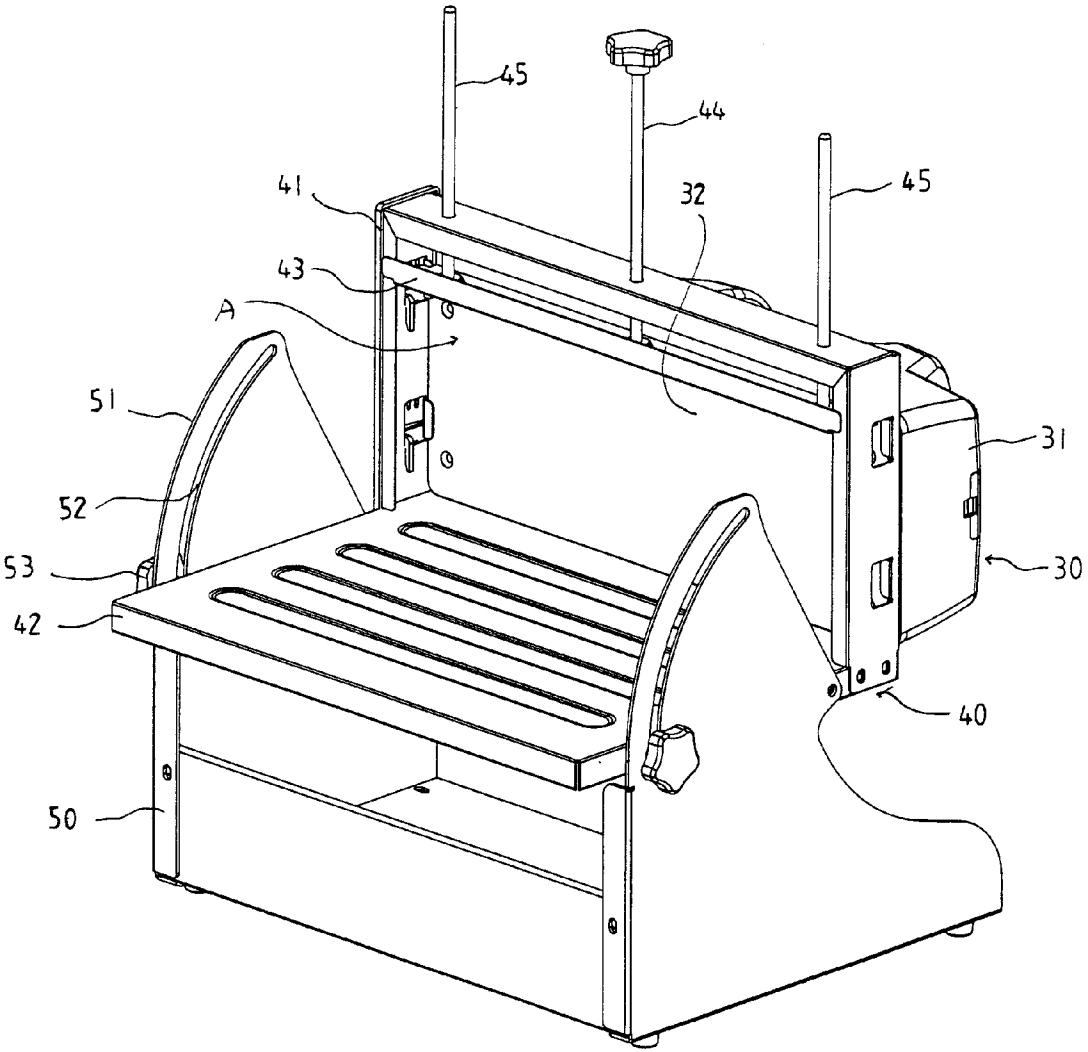
FIGS. 5 and 6 are perspective views of a first preferred embodiment of binding device according to the invention viewed from two opposite angles.
Figure 6:
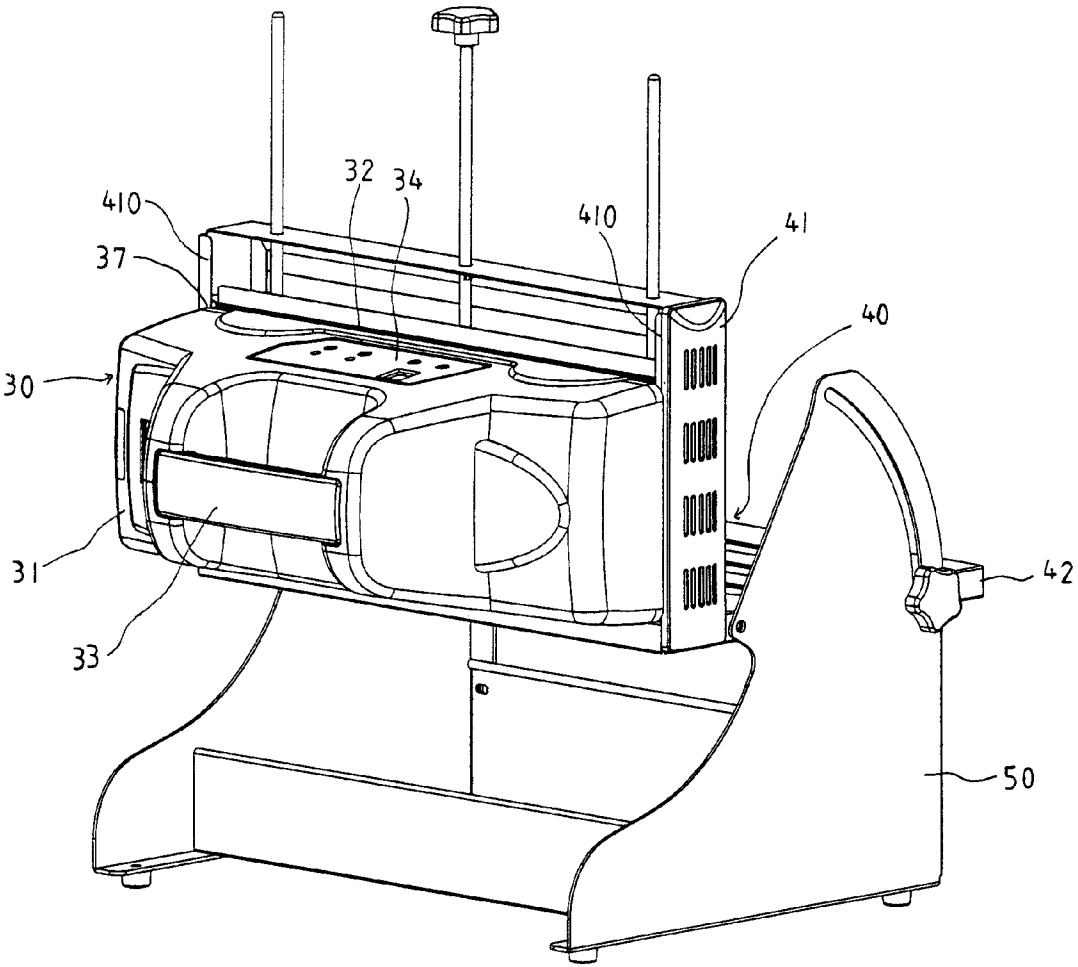
Figure 7:
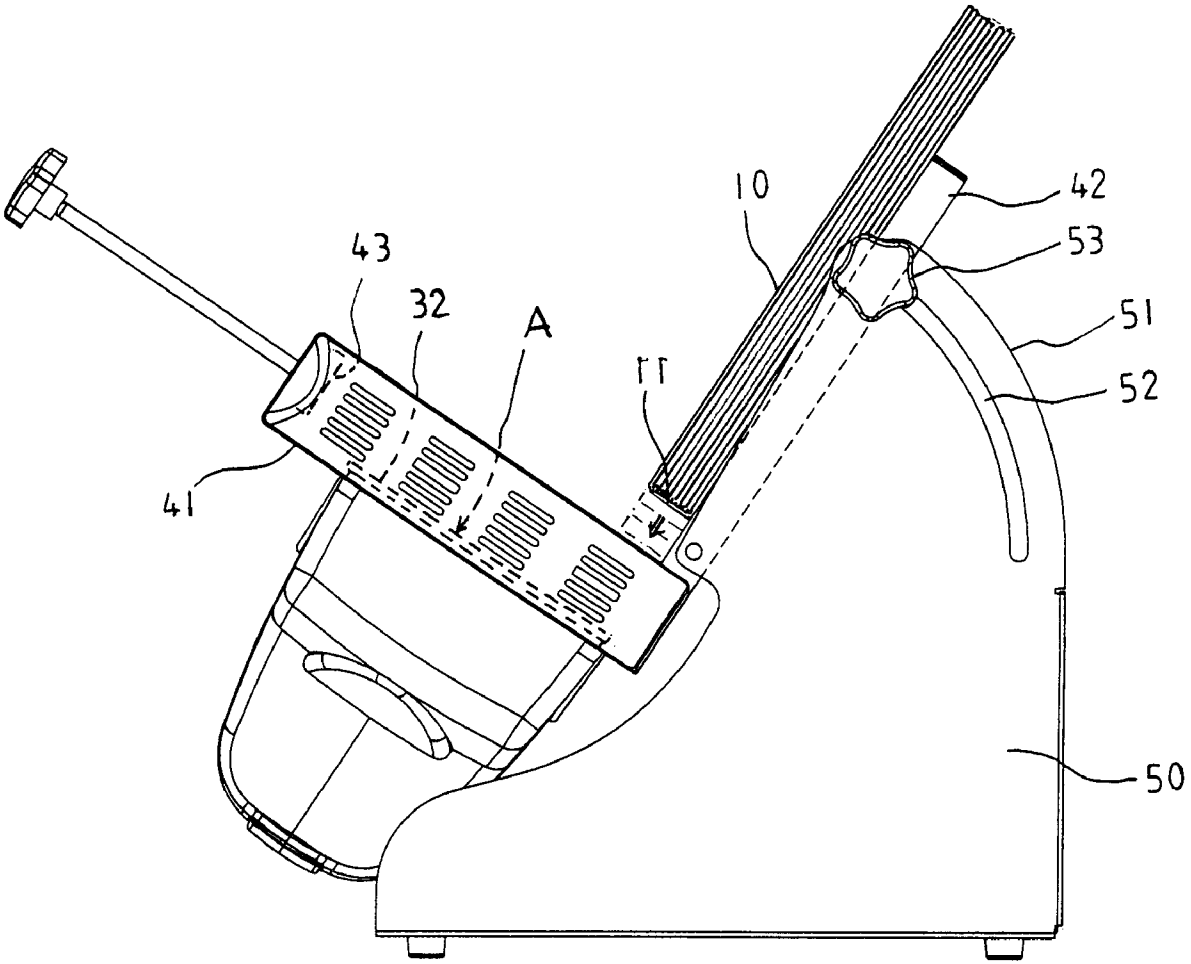
FIG. 7 is a side elevational view of FIG. 6, where a book is placed on the inclined table.
Figure 8:
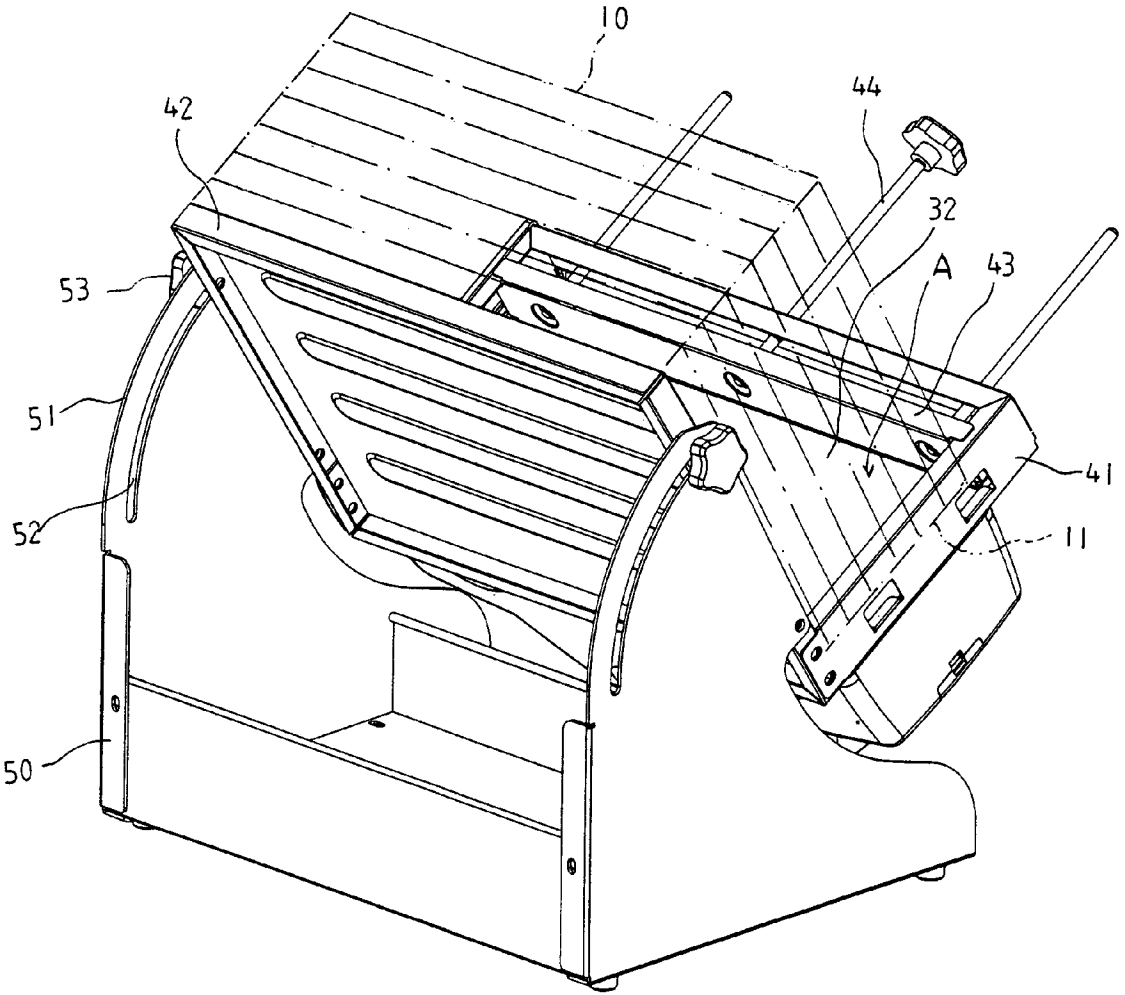
FIG. 8 is a perspective view of the binding device, where a plurality of stacked books are being bound.
Figure 9:
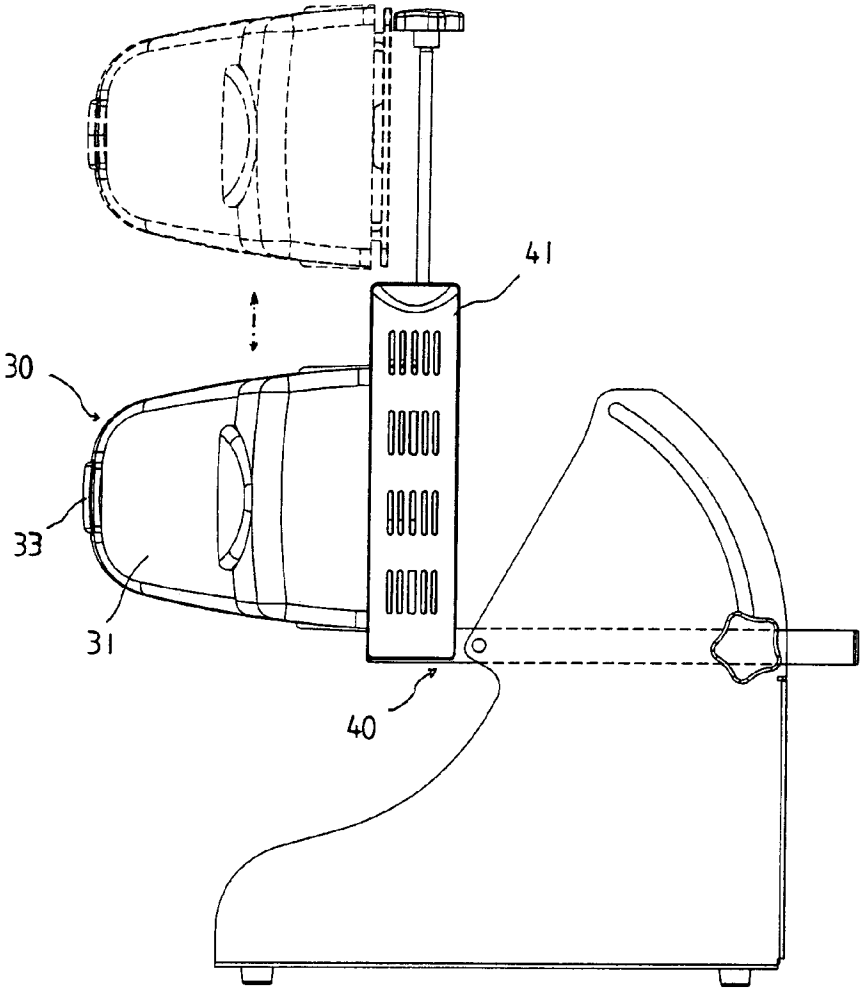
FIG. 9 is a side elevational view of FIG. 6 showing the removal of the heater.
Figure 10:
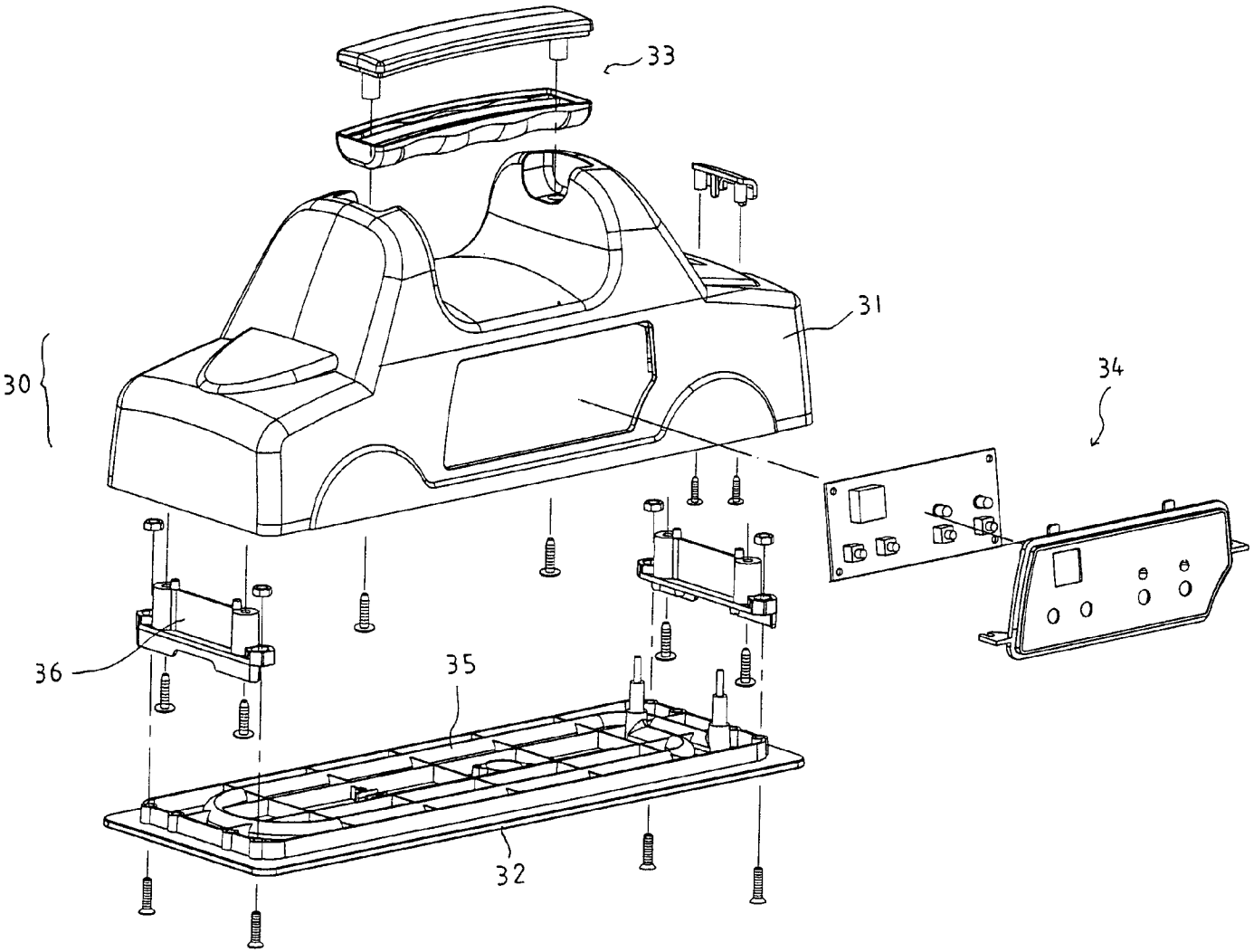
FIG. 10 is an exploded view of the heater.
Figure 11:
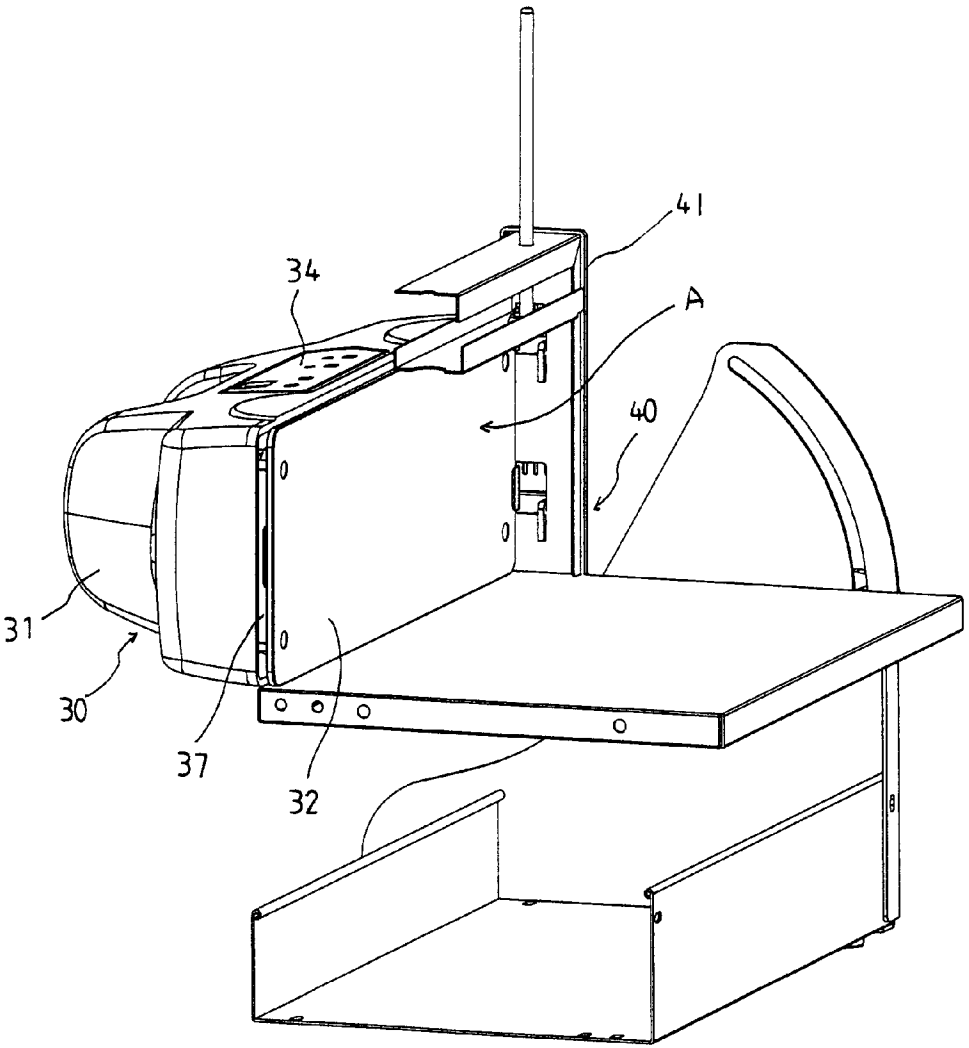
FIG. 11 is a perspective view of the assembled heater and a portion of the frame of the binding device.

Referring to FIGS. 5 to 11, a binding device in accordance with a first preferred embodiment of the invention comprises an L-shaped frame 40 including, at its vertical portion, two uprights 41 each having a rear flange 410, a crossbar-shaped platen 43 interconnecting the upright 41, a central screw 44 having a bottom end secured to the platen 43, and two adjustable side posts 45 having a lower end secured to the platen 43; and, at its horizontal portion, a table 42.

The binding device further comprises a base 50 including two sides 51, two arcuate openings 52 each formed along an edge of an upper portion of the side 51, and two adjustment knobs 53 each adapted to slide in a range defined by two ends of the opening 52. Also, the adjustment knobs 53 are secured to both sides of the table 42 proximate a front end of the table 42.

The binding device further comprises a detachable heater 30 including a body 31, a front panel 32 as a heating area A, two side slots 37, a top control 34, a heating element 45 in the front panel 32, two mounting members 36 for securing the front panel 32 to the body 31, and a rear handle 33. The heater 30 is fastened by placing its front bottom edge on a rear of the table 42 with the fastening cooperation of the flanges 410 and the slots 37.

A book binding process of the invention will be described in detailed below. First, unfasten the adjustment knobs 53 to slide same together with the table 42 from lower ends of the openings 52 to upper ends of the openings 52. Next, fasten the adjustment knobs 53 at the upper ends of the openings 52 for fastening the table 42. Next, unfasten the screw 44 to lift the platen 43 to its maximum or an appropriate height. Next, place a folded cover 10 of a book to be bound with sheets of paper being initially positioned in its central portion 11 in which the cover 10 has a width substantially equal to a distance between the uprights 41 (see FIG. 7). This placing step may take a plurality of times so as to stack a plurality of books of the same size to be bound on the table 42 (see FIG. 8). Next, lower the platen 43 to place same on the top one of the books to be bound. Next, fasten the screw 44 to press the platen 43 on the top book to be bound with the central portions 11 being in contact with the heating area A (i.e., fastening step). Next, activate the heating element 45 to heat and melt adhesive adhered to inner surfaces of the central portions 11 for adhering the sheets of paper to the inner surfaces of the central portions 11. Next, wait for a predetermined period of cooling time. Finally, remove the bound books from the binding device by unfastening the screw 44 and lifting the platen 43.

For detaching the heater 30 simply unfastening the heater 30 and removing same by holding the handle 33.

Figure 12:
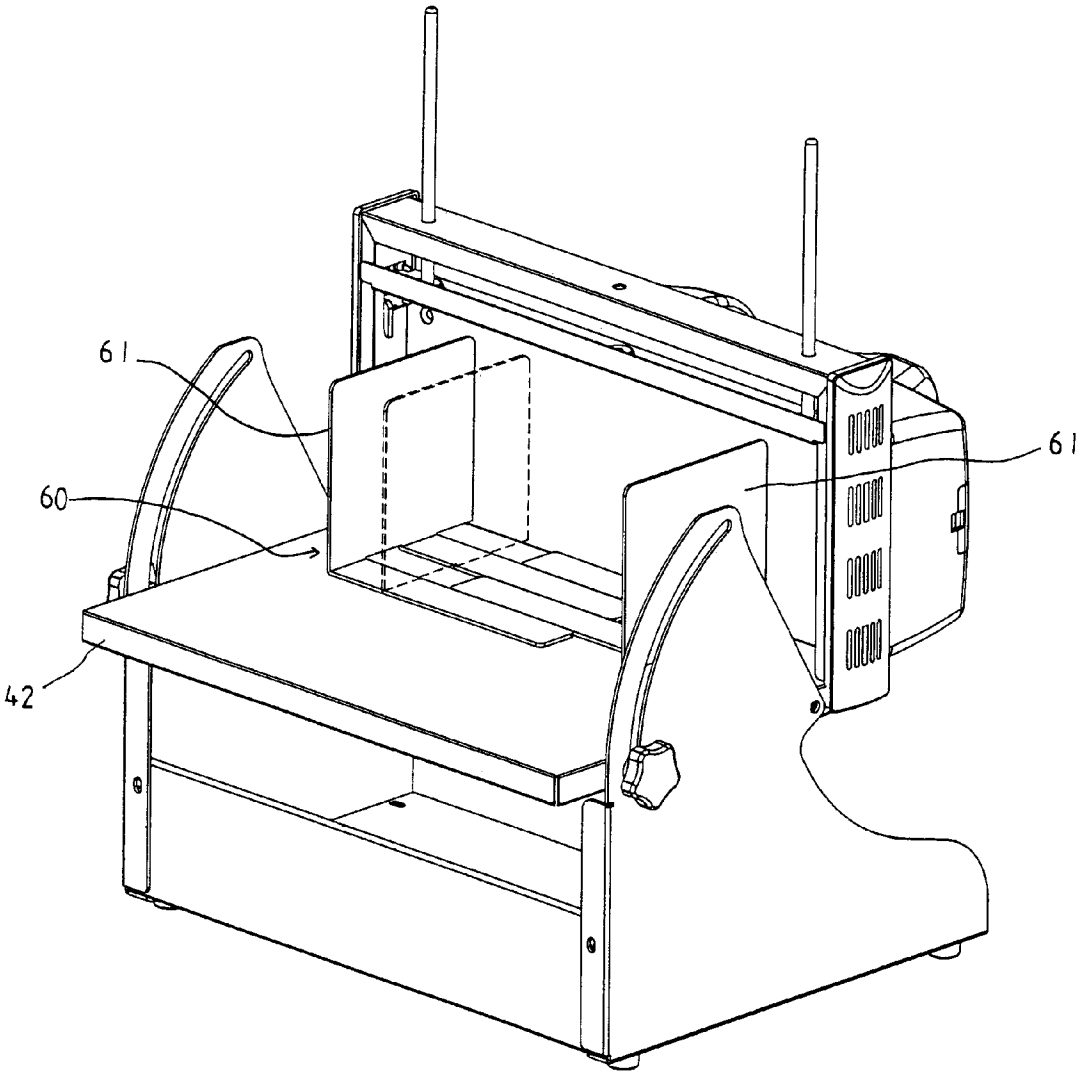
FIG. 12 is a perspective view of a second preferred embodiment of binding device according to the invention.

Referring to FIG. 12, a binding device in accordance with a second preferred embodiment of the invention is shown. The second embodiment is identical to the first embodiment, except that a container 60 having two adjustable book ends 61 is formed on a rear end of the table 42 proximate the front panel (i.e., heating area). One or more books to be bound may be placed in the container 60 prior to fastening same between the book ends 61 by moving the book ends 61 toward each other. This embodiment is adapted to accommodate books to be bound having width less than the distance between the uprights 41.

Figure 13:
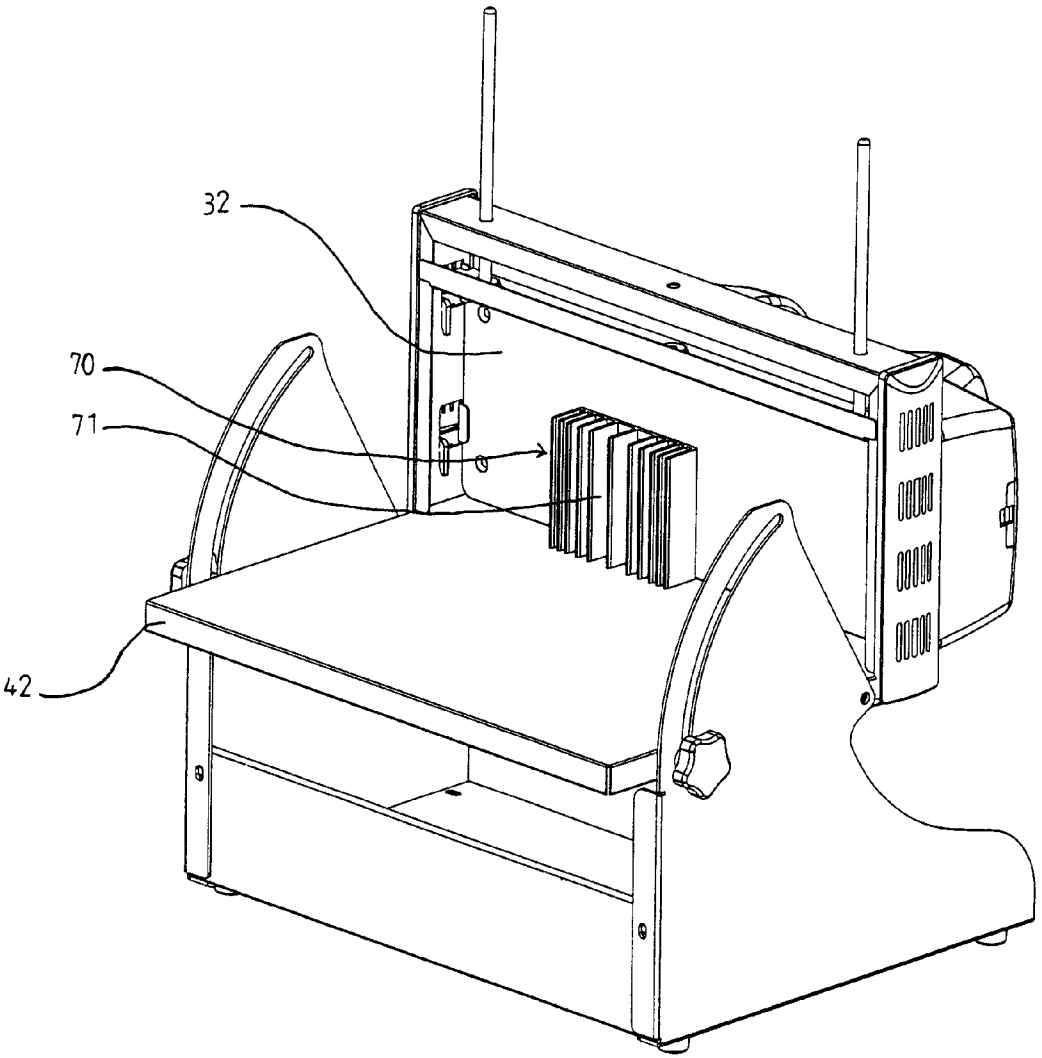
FIG. 13 is a perspective view of a third preferred embodiment of binding device according to the invention.

Referring to FIG. 13, a binding device in accordance with a third preferred embodiment of the invention is shown. The third embodiment is identical to the first embodiment, except that a case 70 having a plurality of compartments 71 of different widths is formed on a rear end of the table 42 proximate the front panel 32 (i.e., heating area). Each book to be bound or a number of books to be bound as a unit may be placed securely in a conformed one of the compartments 71 prior to binding. This embodiment is adapted to accommodate small books to be bound.

While the invention herein disclosed has been described by means of specific embodiments, numerous modifications and variations could be made thereto by those skilled in the art without departing from the scope and spirit of the invention set forth in the claims.

What is claimed is:

1. A binding device comprising:

an L-shaped frame including two uprights each having a rear flange, a crossbar-shaped platen interconnecting the upright, a central screw having a bottom end secured to the platen, and a rectangular table having two rear corners secured to bottoms of the uprights;

a base including two sides, two arcuate openings, each of the arcuate openings formed along an arcuate edge of an upper portion of the respective side, and two adjustment knobs secured to both sides of the table proximate a front end of the table; and a detachable heater releasably secured to a rear end of the table and a vertical section of the uprights, the heater having two side slots for receiving the rear flanges, and the heater including a front heating area;

wherein the adjustment knobs are adapted to slide in a range defined by two ends of the opening to pivot the frame, and the platen is adapted to lift and lower by operating the screw and press one or more books to be bound on the table.

2. The binding device of claim 1, further comprising a container having two adjustable book ends formed on a rear end of the table proximate the heating area.

3. The binding device of claim 1, further comprising a case having a plurality of compartments of different widths formed on a rear end of the table proximate the heating area.

4. A process for binding one or more books in a binding device, the binding device including an L-shaped frame including two uprights each having a rear flange, a crossbar-shaped platen interconnecting the upright, a central screw having a bottom end secured to the platen, and a rectangular table having two rear corners secured to bottoms of the uprights; a base including two sides, two arcuate opening, each of the arcuate openings formed along an arcuate edge of an upper portion of the side respective, and two adjustment knobs secured to both sides of the table proximate a front end of the table; and a detachable heater releasably secured to a rear end of the table and a vertical section of the uprights, the heater having two side slots for receiving the rear flanges, and the heater including a front heating area; the binding process comprising the steps of:

(1) unfastening the adjustment knobs to slide the adjustment knobs together with the table from lower ends of the openings to upper ends of the openings to pivot the frame;

(2) fastening the adjustment knobs and the table;

(3) unfastening the screw to lift the platen to a predetermined height;

(4) placing a folder cover of a book to be bound with sheets of paper being initially positioned in its central portion having its inner surface coated with adhesive;

(5) sequentially placing one or more books to be bound on the book in step (4) if such is desired, with each of the books having sheets of paper positioned in an adhesive coated central portion of a folder cover;

(6) lowering the platen to place the platen on a top book of the books to be bound;

(7) fastening the screw to press the platen on the top book to be bound with the central portion of each of the books to be bound being in contact with the heating area;

(8) activating the heater to heat and melt the adhesive for adhering the sheets of paper to the inner surfaces of the central portions;

(9) deactivating the heater for cooling the books to be bound for a predetermined period of time;

(10) unfastening the screw and lifting the platen; and

(11) removing the bound books from the binding device.

* * * * *